US008540362B2

(12) United States Patent
Yamaya

(10) Patent No.: US 8,540,362 B2
(45) Date of Patent: Sep. 24, 2013

(54) LIQUID EJECTION DEVICE

(71) Applicant: Seiko Epson Corporation, Tokyo (JP)

(72) Inventor: Keisuki Yamaya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/705,614

(22) Filed: Dec. 5, 2012

(65) Prior Publication Data

US 2013/0093823 A1 Apr. 18, 2013

Related U.S. Application Data

(63) Continuation of application No. 13/031,850, filed on Feb. 22, 2011, now Pat. No. 8,348,417.

(30) Foreign Application Priority Data

Mar. 3, 2010 (JP) ..... 2010-046290

(51) Int. Cl.
*B41J 2/01* (2006.01)

(52) U.S. Cl.
USPC ..... 347/104

(58) Field of Classification Search
None
See application file for complete search history.

(56) References Cited

U.S. PATENT DOCUMENTS 4,774,525 A 9/1988 Mitsushima et al.
5,134,915 A 8/1992 Fukano et al.

FOREIGN PATENT DOCUMENTS

JP 63-051163 A 3/1988
JP 03-269450 A 12/1991

*Primary Examiner* — Stephen Meier
*Assistant Examiner* — Tracey McMillion
(74) *Attorney, Agent, or Firm* — Global IP Counselors, LLP

(57) ABSTRACT

A liquid ejection device includes a first rolled medium accommodation unit, a second rolled medium accommodation unit and a liquid ejection head. The first rolled medium accommodation unit is configured to accommodate a rolled medium, the first rolled medium accommodation unit being movable along a first path. The second rolled medium accommodation unit is configured to accommodate the rolled medium, the second rolled medium accommodation unit being movable along a second path. The liquid ejection head is configured to eject an ink as a liquid onto a medium supplied by being unwound from the rolled medium.

5 Claims, 10 Drawing Sheets

LIQUID EJECTION DEVICE

CROSS-REFERENCE TO RELATED APPLICATIONS

This application is a continuation application of U.S. application Ser. No. 13/031,850 filed on Feb. 22, 2011. This application claims priority to Japanese Patent Application No. 2010-046290 filed on Mar. 3, 2010. The entire disclosures of U.S. application Ser. No. 13/031,850 and Japanese Patent Application No. 2010-046290 are hereby incorporated herein by reference.

BACKGROUND

1. Technical Field

The present invention relates to a rolled medium accommodation device and a liquid ejection device comprising this rolled medium accommodation device.

2. Related Art

There are known liquid ejection devices in which a liquid (e.g. ink) is ejected from a liquid ejection head and deposited onto a recording medium (paper or the like), whereby a predetermined image (including letters, pictures, and the like) is printed on the paper. In this type of liquid ejection device, in cases of large-scale printing requiring numerous sheets of paper or cases of performing elongated printing with a long printing range in the paper conveying direction, the paper must be continuously supplied to the consuming side where the paper is consumed by the printing. Therefore, such a liquid ejection device is provided with a roll paper accommodation device whereby, when roll paper (a rolled medium) consisting of elongated paper (continuous paper) wound into a roll is accommodated, the roll paper is rotated and the paper can thereby be unwound from the roll paper to be unreeled and supplied to the consuming side.

Such a roll paper accommodation device is provided with a roll paper accommodation unit for accommodating roll paper. When the paper has been unwound from the accommodated roll paper and entirely consumed, a lid provided to the roll paper accommodation unit is opened and the roll paper is replaced with new roll paper. There have been proposals of various structures in which urging unit for urging the lid in the opening direction are provided in order to make it easier to open and close the lid, for cases in which the lid is heavy in weight, for example, or the lid is otherwise not easily opened and closed at this time. Japanese Laid-Open Patent Publication No. 63-51163, for example, discloses a configuration of a thermal transfer printer comprising a gas spring axially supported at one end on a turning frame. Consequently, if such a configuration is used for the lid of the roll paper accommodation unit, the lid is opened and closed easily.

However, there are cases in which roll paper for supplying paper to the consuming side, or roll paper for replacement, for example, is accommodated within the liquid ejection device separately from the roll paper accommodated in the roll paper accommodation unit. In this case, when the liquid ejection device is being used, the removal portion when the separate roll paper is removed from the liquid ejection device is sometimes blocked by the roll paper accommodation unit. In such cases, the separate accommodated roll paper must be removed from the liquid ejection device by swinging (raising) the roll paper accommodation unit in the opposite direction of gravity around one shaft provided to the liquid ejection device, so that the removal portion is not blocked.

Therefore, the configuration disclosed in Japanese Laid-Open Patent Publication No. 63-51163 is effective when used as the roll paper accommodation unit. Specifically, by providing a gas spring so as to apply urging force opposing the total weight of the entire roll paper accommodation unit including the accommodated roll paper, the roll paper accommodation unit can easily be swung in the opposite direction of gravity. When the roll paper accommodation unit has risen in the opposite direction of gravity and reached the high position by swinging, it can be prevented from falling in the direction of gravity due to its own weight. The removal portion is thereby not blocked by the roll paper accommodation unit, and the roll paper accommodated in the liquid ejection device can therefore be easily removed.

SUMMARY

A liquid ejection device according to one aspect of the present invention includes a first rolled medium accommodation unit, a second rolled medium accommodation unit and a liquid ejection head. The first rolled medium accommodation unit is configured to accommodate a rolled medium, the first rolled medium accommodation unit being movable along a first path. The second rolled medium accommodation unit is configured to accommodate the rolled medium, the second rolled medium accommodation unit being movable along a second path. The liquid ejection head is configured to eject an ink as a liquid onto a medium supplied by being unwound from the rolled medium.

BRIEF DESCRIPTION OF THE DRAWINGS

Referring now to the attached drawings which form a part of this original disclosure.

DETAILED DESCRIPTION OF EXEMPLARY EMBODIMENTS

Embodiments are described hereinbelow using the drawings, wherein the present invention is specified as an inkjet printer (hereinbelow also shortened to "printer"), which is one type of a liquid ejection device.

Figure 1A:
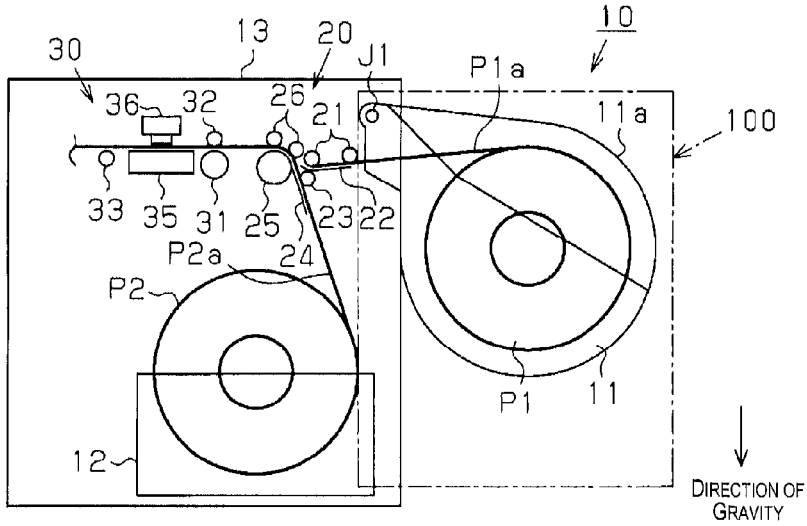
FIGS. 1A and 1B are schematic views showing the general configuration of the printer of an embodiment of the present invention.
Figure 1B:
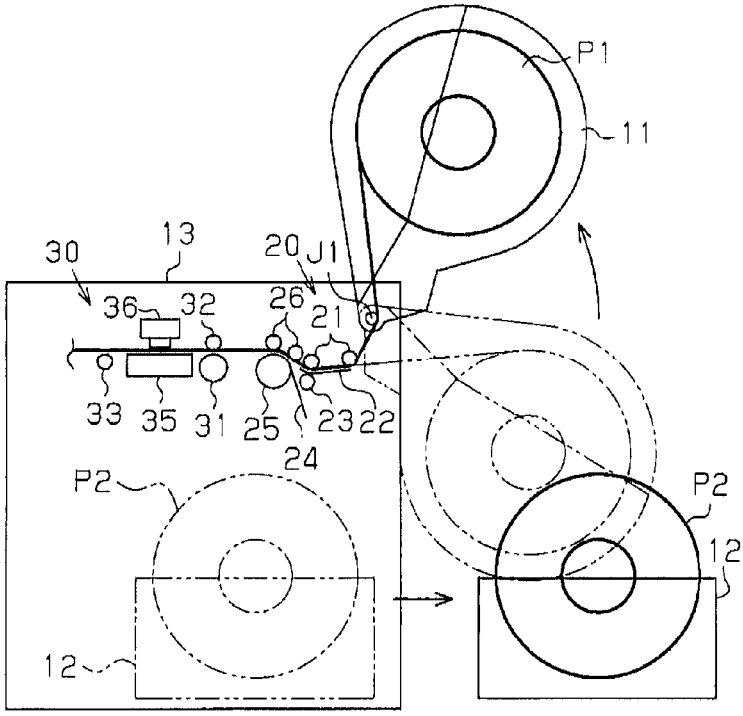

FIGS. 1A and 1B are schematic sectional views of a printer 10 comprising the roll paper accommodation device (rolled medium accommodation device) 100 of the present embodiment. The printer 10 has a substantially box-shaped casing 13 as an outer covering, and inside the casing 13 is disposed a tray 12 (a second rolled medium accommodation unit) which accommodates roll paper (a rolled medium) P2 which is the supply source of the paper (medium) consumed by printing, as shown in FIG. 1A. Outside of the casing 13 is provided a roll paper accommodation unit 11 (a first rolled medium accommodation unit) having a housing structure in which roll paper P1, a similar paper supply source, is accommodated in an internal space. The term "roll paper" refers to elongated paper (specifically, continuous paper) wound into the form of a roll, and paper is unwound from the roll paper and supplied for consumption by rotating the roll paper about its axis.

The roll paper accommodation unit 11 is mounted to the casing 13 in a state of being capable of swinging along an arcuate path about a first shaft J1 as one axis in the top vicinity of the casing 13. The roll paper accommodation device 100 of the present embodiment is configured from the roll paper accommodation unit 11 and a mechanism incorporated inside the casing 13 in order to perform the swinging action of the roll paper accommodation unit 11 (see FIG. 2). The roll paper accommodation unit 11 is provided with a lid 11*a* which can be opened and closed, and the roll paper P1 can be replaced with new roll paper by opening the lid 11*a*. The tray 12 is configured so as to be taken out of the casing 13 by moving (sliding) along a straight path in a direction (to the right in the drawing) orthogonal to the direction of gravity (downward in the drawings), and with the tray having been taken out, the roll paper P2 can be replaced with new roll paper.

Furthermore, in the following order downstream in the conveying direction of the paper, the printer 10 comprises a roll paper switching unit 20 and a printing unit 30 where the paper unwound from the roll paper is consumed. The roll paper switching unit 20 comprises rollers 21, 23, a conveying drive roller 25, conveying driven rollers 26, and receiving plates 22, 24 for receiving the paper, wherein the paper supply source is switched. Specifically, when the supply source is the roll paper P1, the configuration is set up so that the paper P1*a* pulled out from the roll paper P1 is conveyed by the two rollers 21 and the receiving plate 22 in order to be inserted between the conveying drive roller 25 and the two conveying driven rollers 26. When the supply source is the roll paper P2, the configuration is set up so that the paper P2*a* pulled out from the roll paper P2 is conveyed by the roller 23 and the receiving plate 24 in order to be inserted between the conveying drive roller 25 and the two conveying driven rollers 26. The configuration is also set up so that when the roll paper being used as the supply source is switched, the rollers 21, 23 rotate in a direction of winding the paper back around the roll paper not being used as the supply source as necessary.

The printing unit 30 has a liquid ejection head 36 for ejecting ink as a liquid, and a platen 35 for supporting the paper P1*a* or the paper P2*a* (hereinafter referred to collectively as "paper P") which are the ink ejection targets. The printing unit 30 also has a paper-feeding roller 31, a driven roller 32, and a paper ejection roller 33. The paper-feeding roller 31 and the driven roller 32 are designed so as to convey the paper P supplied by the roll paper switching unit 20 by a predetermined amount relative to the liquid ejection head 36. Ink is then ejected from the liquid ejection head 36 onto this paper P being conveyed by a predetermined amount, and an image or the like is printed on the surface of the paper P. The liquid ejection head 36 is a stationary head in which carriage heads and nozzles that move in the width direction of the conveyed paper P are formed substantially across the paper width.

The paper P that has undergone printing is then cut into predetermined lengths in the conveying direction by a cutting device (not shown), and is conveyed to an ejection tray or another ejection position (also not shown). In this manner is the paper P (P1*a*, P2*a*) in the roll paper P1 and roll paper P2 consumed. FIG. 1A shows a state in which the paper P2*a* pulled out from the roll paper P2 is supplied to the printing unit 30 and subjected to printing.

When all of the paper P2*a* pulled out from the roll paper P2 has been consumed by printing in the printing unit 30, the roll paper P2 of the tray 12 must be replaced with new roll paper at the same time that the paper supply source being used is switched from the roll paper P2 to the unused roll paper P1. At this time, since the roll paper P2 is placed in the tray 12 disposed in the interior of the printer 10 having the substantially box-shaped casing 13 as previously described, the tray 12 must be pulled out of the casing 13 in order to replace the roll paper P2.

In such an operation for replacing the roll paper P2, within the roll paper accommodation device 100, the roll paper accommodation unit 11 is swung using rotational torque about the first shaft J1 caused by urging unit (not shown) in order to pull the tray 12 out of the casing 13 as shown in FIG. 1B. Specifically, the roll paper accommodation unit 11 is swung (i.e., raised) using the urging force of the urging unit from its position during regular use of the printer 10, i.e., a low position in the direction of gravity shown by the double-dashed lines in the drawing, to a high position in the direction of gravity shown by the solid lines in the drawing. At this time, the roll paper P1 placed in the roll paper accommodation unit 11 is at its heaviest due to being a new unused product, but the roll paper accommodation device 100 of the present embodiment is fashioned so that the roll paper accommodation unit 11 does not fall in the direction of gravity even in such cases. The design is also such that when the roll paper accommodation unit 11 is pushed down against the urging force of the urging unit from the high position to the low position, which is the position during regular use, the operating force is suppressed so as to not be too great. The first and second embodiments, wherein such designs are implemented in the roll paper accommodation device 100 of the present embodiment, are described hereinbelow with reference to the drawings.

First Embodiment

Figure 2:
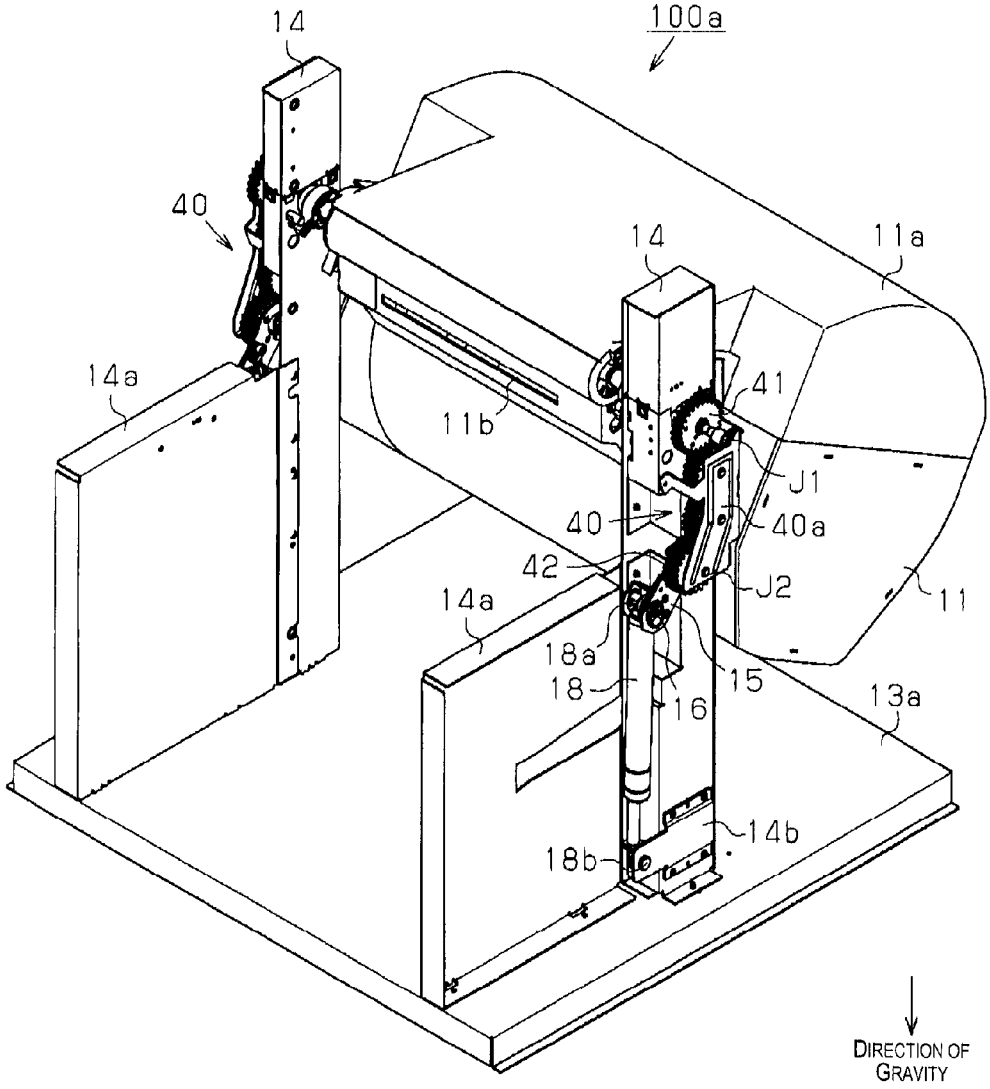
FIG. 2 is a perspective view showing the configuration of a roll paper accommodation device of the first embodiment.

FIG. 2 is a perspective view showing the configuration of a roll paper accommodation device 100*a* of the first embodiment. Except for the roll paper accommodation device 100*a*, there are no depictions of structural elements associated with the printer 10. In the description hereinbelow, the direction of gravity is sometimes referred to as "down" or "downward," and the direction opposite that of gravity is sometimes referred to as "up" or "upward."

The roll paper accommodation device 100*a* is configured from a roll paper accommodation unit 11, and mechanical components for swinging the roll paper accommodation unit incorporated within a casing 13 (not shown). The configuration thereof is described hereinbelow.

First, the tray 12 (not shown) is provided with a sliding base part 13*a* in the top surface, and the base part 13*a* is provided with two support braces 14 which are stood upright and separated so that the tray 12 can be accommodated between partitioning plates 14*a* provided at the bottom. A rotating shaft axially supported at both ends is provided as the first shaft J1 to a position at the top of the two support braces 14 and is fixed in place relative to the first shaft J1, and the roll paper accommodation unit 11 is mounted so as to swing about the first shaft J1. The roll paper accommodation unit 11 comprises a lid 11*a* that can be opened and closed, and is configured so that the roll paper P1 can be accommodated in and taken out of the interior by opening the lid 11*a*. The paper pulled out from the accommodated roll paper P1 is then conveyed through the opening 11*b* to the printing unit 30 (see FIG. 1) where it is consumed.

The support braces 14 are each provided with a rotation-transmitting unit 40 composed of four spur gears. Of the four spur gears, a spur gear 41 positioned at one of the meshing ends is designed so as to rotate integrally with the first shaft J1. A spur gear 42 positioned at the other end is configured so as to rotate about a second shaft J2 axially supported between the support brace 14 and a press plate 40*a*. The other two spur gears positioned between these first two are also configured so as to rotate about axes supported between the support brace 14 and the press plate 40*a*, similar to the spur gear 42.

In the present embodiment, the spur gear 42 is fixed to the second shaft J2. A plate-shaped lever member 15, which swings about the second shaft J2 integrally with the turning of the second shaft J2, is provided fixed in place on the second shaft J2. As a result, the rotation-transmitting unit 40 is configured so that the rotation of the first shaft J1, which turns along with the swinging of the roll paper accommodation unit 11, is transmitted to the second shaft J2, and the second shaft J2 rotates in conjunction with the first shaft J1.

An opening hole 15*a* (see FIG. 4), described hereinafter, is provided to the lever member 15, and a shaft member 16 is provided which is capable of moving along the shape of this opening hole while engaging with the opening hole along a direction (i.e., the plate surface direction of the lever member 15) orthogonal to the axial direction of the second shaft J2 within the opening hole. In the present embodiment, the shaft member 16 has a substantially cylindrical shape, and the side surface portion thereof is designed to mesh with the opening hole of the lever member 15. In the present embodiment, an L-shaped bent plate is attached to the lever member 15 at the end opposite of the second shaft J2, and an opening hole of the same shape is formed in this bent plate. The two opening holes are disposed so as to overlap each other when seen from the axial direction of the shaft member 16, and the configuration is designed so that the two opening holes mesh respectively with the side surface portions in the end vicinities of the cylindrical portion of the shaft member 16.

Fixed to the shaft member 16 near the center is one end (the top end) 18*a* of a gas spring 18 as urging unit. The other end (the bottom end) 18*b* of the gas spring 18 is turnably fixed to a fixed plate 14*b* which is fixed in place to the support brace 14. Consequently, the gas spring 18 is designed so as to urge the shaft member 16 upward by urging force. As a result, the shaft member 16 meshes with the opening hole and serves as a point of action where the lever member 15 is subjected to urging force for causing the lever member 15 to swing (rise) about the second shaft J2.

Figure 3:
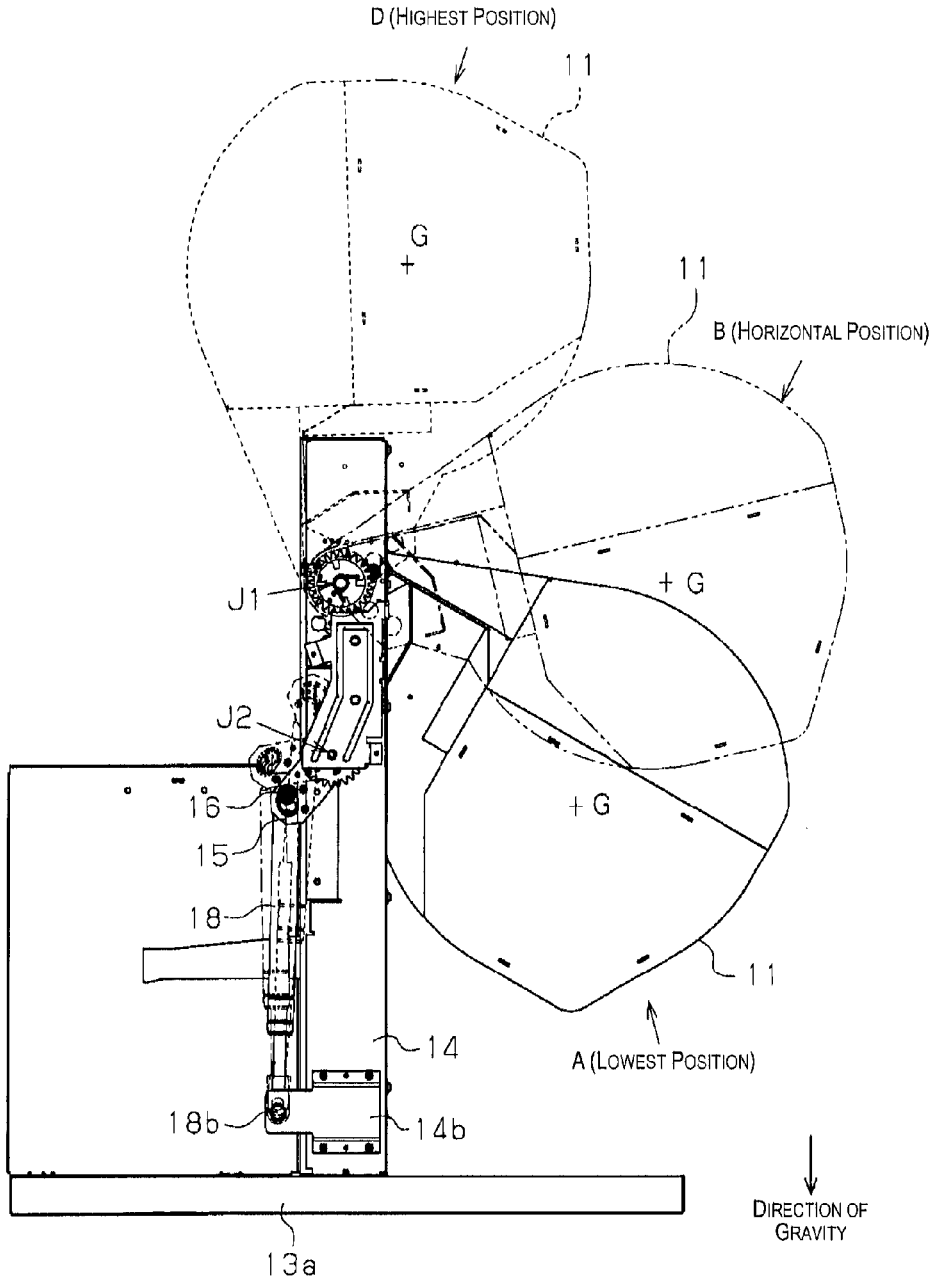
FIG. 3 is a side view showing the swinging state of the roll paper accommodation unit in the first embodiment.

The roll paper accommodation device 100*a* of the first embodiment configured in this manner is also configured so that when the lever member 15 is swung by the urging force of the gas spring 18, the roll paper accommodation unit 11 is swung and displaced from a lowest position A as the low position to a highest position D as the high position. The details of this swinging are described using FIG. 3. FIG. 3 is a side view of the roll paper accommodation device 100*a* shown in FIG. 2, as seen from the axial direction of the first shaft J1. Consequently, the elements of the roll paper accommodation device 100*a* are denoted by the same symbols as those of FIG. 2, and descriptions thereof are omitted.

First, the printer 10 is in the regular usage state, or, in other words, the lever member 15 is in the state shown by the solid lines. At this time, the roll paper accommodation unit 11 is positioned in the lowest position A. In this state, the gas spring 18 generates force that acts to swing the roll paper accommodation unit 11 upward by urging the lever member 15. In other words, the urging force of the gas spring 18 is designed so that rotational torque applied in the reverse direction (the direction opposite that of gravity) is greater than the rotational torque around the first shaft J1 generated when the weight of the roll paper accommodation unit 11 is added to the center of gravity G of the roll paper accommodation unit 11. Consequently, in the lowest position A during regular use in the present embodiment, the roll paper accommodation unit 11 is locked by a locking mechanism (not shown) so as to not swing upward, and the roll paper accommodation unit 11 is held in the lowest position A. The connected lever member 15 is also incapable of swinging.

The roll paper accommodation unit 11 is enabled to swing about the first shaft J1 by releasing the lock of the locking mechanism in order to replace the roll paper P2. Consequently, the lever member 15 begins to swing about the second shaft J2 due to the urging force of the gas spring 18. The second shaft J2 then rotates along with the swinging of the lever member 15, and the first shaft J1 connected thereto therefore also rotates. As a result, the roll paper accommodation unit 11 swings about the first shaft J1, i.e., rises from the lowest position A to the highest position D shown by the dashed lines in the drawing.

In this swinging process, when the position of the center of gravity G of the roll paper accommodation unit 11 is in the horizontal position B (the double-dashed lines in the drawing) at substantially the same height as the first shaft J1 in the direction of gravity, the rotational torque of the lever member 15 around the second shaft J2 as caused by the urging force of the gas spring 18 reaches a maximum. Specifically, the position of maximum rotational torque around the first shaft J1 generated by the weight of the roll paper accommodation unit 11 coincides with the position of maximum rotational torque of the lever member 15 around the second shaft generated by the urging force of the gas spring 18.

In a state in which the roll paper accommodation unit 11 has swung further and reached the highest position D as shown by the dashed lines in the drawing, the necessary rotational torque is applied to the lever member 15 so that the roll paper accommodation unit 11 falls in the direction of gravity due to its own weight. Specifically, in the highest position D, the design is such that upward rotational torque, which is greater than the downward rotational torque around the first shaft J1 generated when the weight of the roll paper accommodation unit 11 is added to the center of gravity G, is reliably applied to the first shaft J1 without changing (increasing) the urging force of the gas spring 18. Specifically, the configuration is designed so that the shaft member 16 moves so that the distance between the center of the shaft member 16 and the center of the second shaft J2 is longer in the highest position D than in a position lower than the highest position D (e.g., the horizontal position B or the lowest position A). This configuration is described in detail using FIG. 4 together with the movement action of the shaft member 16.

Figure 4:
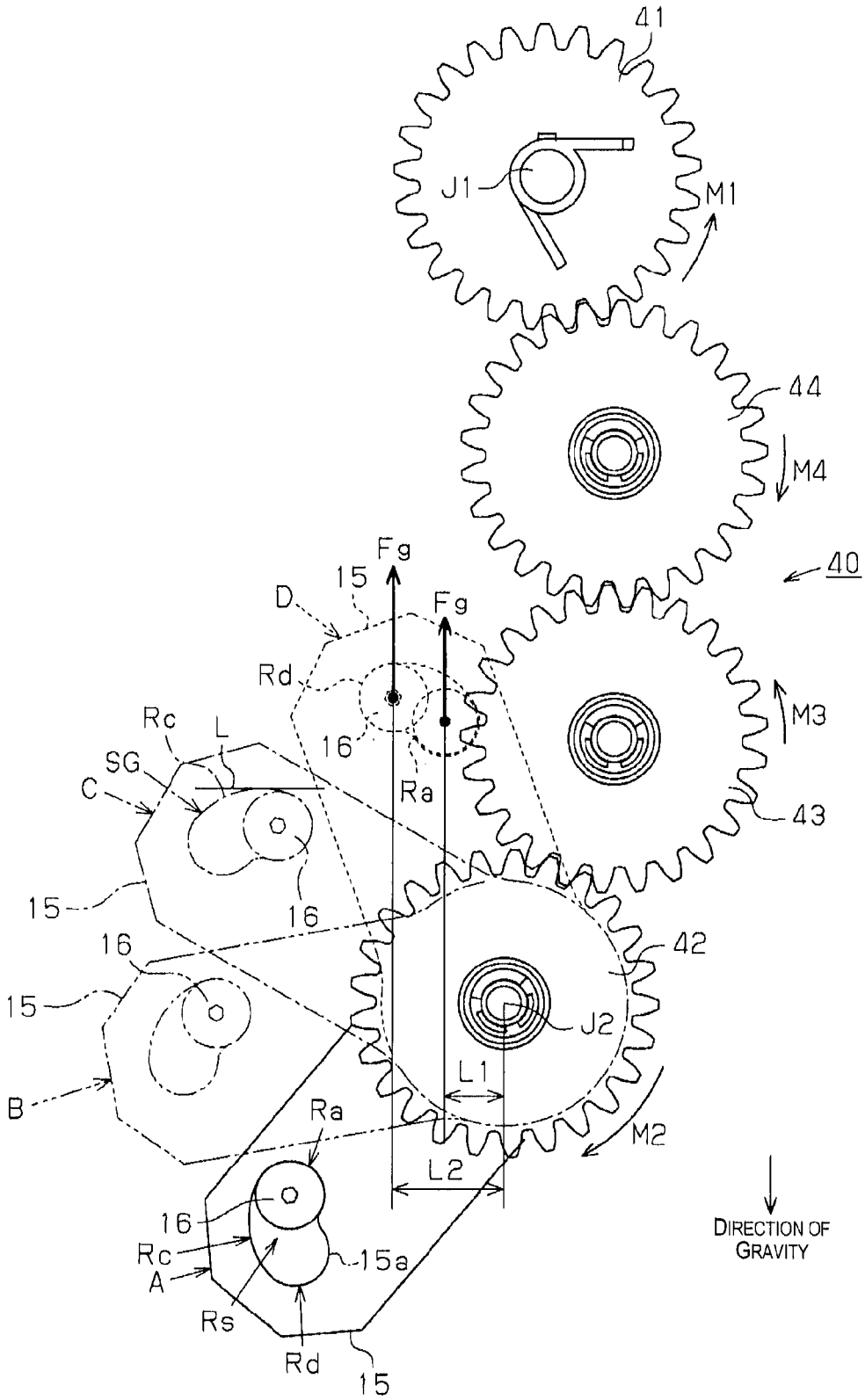
FIG. 4 is a descriptive drawing for describing the movement of the shaft member through the swinging positions in the first embodiment.

FIG. 4 is an enlarged view of part of FIG. 3, showing the configurations of the lever member 15, the shaft member 16, and the rotation-transmitting unit 40. In FIG. 4, there are no depictions of structural elements of the roll paper accommodation device 100*a* that are not necessary for describing the movement action of the shaft member 16.

As illustrated, the rotation-transmitting unit 40 comprises a spur gear 41 as a first gear which turns integrally with the roll paper accommodation unit 11 about the first shaft J1, and a spur gear 42 as a second gear which turns integrally with the lever member 15 about the second shaft J2, as previously described. Two spur gears 43, 44 as third gears are provided between the spur gear 41 and the spur gear 42, and the meshing and rotating of these two gears allows the turning of the spur gear 41 and the turning of the spur gear 42 to be conjoined. The swinging of the roll paper accommodation unit 11 about the first shaft J1 and the swinging of the lever member 15 about the second shaft J2 are thereby conjoined.

Therefore, the rotational torque M2 around the second shaft J2 of the spur gear 42 is relayed and transmitted as sequential rotational torques M3, M4 by the spur gear 43 and the spur gear 44, and the rotational torque M1 around the first shaft J1 is generated in the spur gear 41. Conversely, the rotational torque M1 around the first shaft J1 generated by the spur gear 41 is relayed and transmitted as the sequential rotational torques M4, M3 by the spur gear 44 and the spur gear 43, and the rotational torque M2 around the second shaft J2 is generated in the spur gear 42.

In the present embodiment, the gear trains are all configured from the same gears. Consequently, the rotational torque M1 around the first shaft J1 (hereinafter simply "rotational torque M1") and the rotational torque M2 around the second shaft (hereinafter simply "rotational torque M2") coincide with each other. If at least the spur gear 41 and the spur gear 42 are configured from the same gears, the rotational torque M1 and the rotational torque M2 have the same torque value even if the spur gear 43 and the spur gear 44 have different numbers of teeth (pitch diameters).

In the present embodiment, the rotation-transmitting unit 40 has two (an even number of) gears between the spur gear 41 and the spur gear 42. As a result, the rotational direction of the spur gear 41 when the roll paper accommodation unit 11 swings from the lowest position A to the highest position D is the opposite direction of the rotational direction of the spur gear 42 which rotates along with the swinging of the lever member 15 when the roll paper accommodation unit 11 swings. Specifically, in FIG. 4, the rotational direction of the spur gear 41 is counterclockwise, and the rotational direction of the spur gear 42 is clockwise. Consequently, the lever member 15 is disposed on the side of the second shaft J2 opposite from the roll paper accommodation unit 11. The rotation may be transmitted between the spur gear 41 and the spur gear 42 using an odd number of spur gears. In this case, the lever member 15 is disposed on the same side as the roll paper accommodation unit 11 relative to the second shaft J2.

The previously-described opening hole 15*a* is provided to the lever member 15 as shown in FIG. 4. This opening hole 15*a* is an opening roughly in the shape of a broad bean having two circular holes Ra, Rd opened around two positions at different distances from the second shaft J2, wherein the two circular holes Ra, Rd are joined by an arcuate slit Rs having an opening width equal to the outside diameter dimensions of these two circular holes Ra, Rd. When the roll paper accommodation unit 11 is in the lowest position A as shown by the solid lines in the drawing, the shaft member 16, which urges the lever member 15 in the direction opposite that of gravity, is engaged with the opening hole 15*a* and positioned in the portion of the circular hole Ra which is nearer to the second shaft J2.

The shaft member 16 continues to be engaged with the opening hole 15*a* and positioned in the portion of the circular hole Ra which is nearer to the second shaft J2 when the roll paper accommodation unit 11 is in the horizontal position B as well, similar to the lowest position A.

When the roll paper accommodation unit 11 is in a position C which is between the horizontal position B and the highest position D as shown by the single-dotted line in the drawing, a tangent line L in the arcuate-shaped portion of the opening hole 15*a* joined to the circular hole Ra of the upper arcuate-shaped portion Rc becomes substantially horizontal in direction. From this position C, the shaft member 16 is mechanically moved within the opening hole 15*a* by the urging force of the gas spring 18 so as to make contact at a position in the slit Rs where the tangent line of the upper arcuate-shaped portion Rc is horizontal. At this time, in the present embodiment, the arcuate-shaped portion Re is formed so that the shaft member 16 moves with the rising of the lever member 15 so as to become farther distanced from the second shaft J2. As a result, the shaft member 16, which urges the lever member 15 upward by the urging force of the gas spring 18, moves along the upper arcuate-shaped portion Rc of the engaged opening hole 15*a* from the position of the circular hole Ra nearer to the second shaft J2 toward the position of the farther circular hole Rd. When the roll paper accommodation unit 11 reaches the highest position D, the shaft member 16, which urges the lever member 15 upward while being engaged with the opening hole 15*a*, is placed in the circular hole Rd, which is farther from the second shaft J2, at a point opposite that of the lowest position A, as shown by the dashed lines in the drawing. Therefore, the opening hole 15*a*, and particularly the upper arcuate-shaped portion Re and the circular holes Ra, Rd, function as a guiding part SG for guiding the movement of the shaft member 16. The position C is a "movement starting position C" of the shaft member 16.

Thus, when the roll paper accommodation unit 11 swings into the highest position D, the shaft member 16, which is the point on which the urging force of the gas spring 18 acts, moves within the opening hole 15*a* provided to the lever member 15 with the opening hole 15*a* serving as a guiding part SG in the lever member 15. When the shaft member 16 has finished moving, it is positioned farther away from the second shaft J2 than a low position in the direction of gravity, i.e., than the position in the lowest position A. Consequently, in the highest position D as shown in FIG. 4, L1 is the distance of separation between the second shaft J2 and the shaft member 16 in the direction orthogonal to the direction of gravity when the shaft member 16 does not move from its position in the lowest position A. On the other hand, in the highest position D, when the shaft member 16 has moved through the opening hole 15*a* as described above, the distance of separation between the second shaft J2 and the shaft member 16 in the direction orthogonal to the direction of gravity is L2, which is a greater value than L1. Consequently, denoting the urging force of the gas spring 18 as Fg, the rotational torque M1 opposing the falling in the direction of gravity of the roll paper accommodation unit 11 in the highest position D is the same value as the rotational torque M2. In other words, Fg×L2 is greater than Fg×L1.

Figure 5:
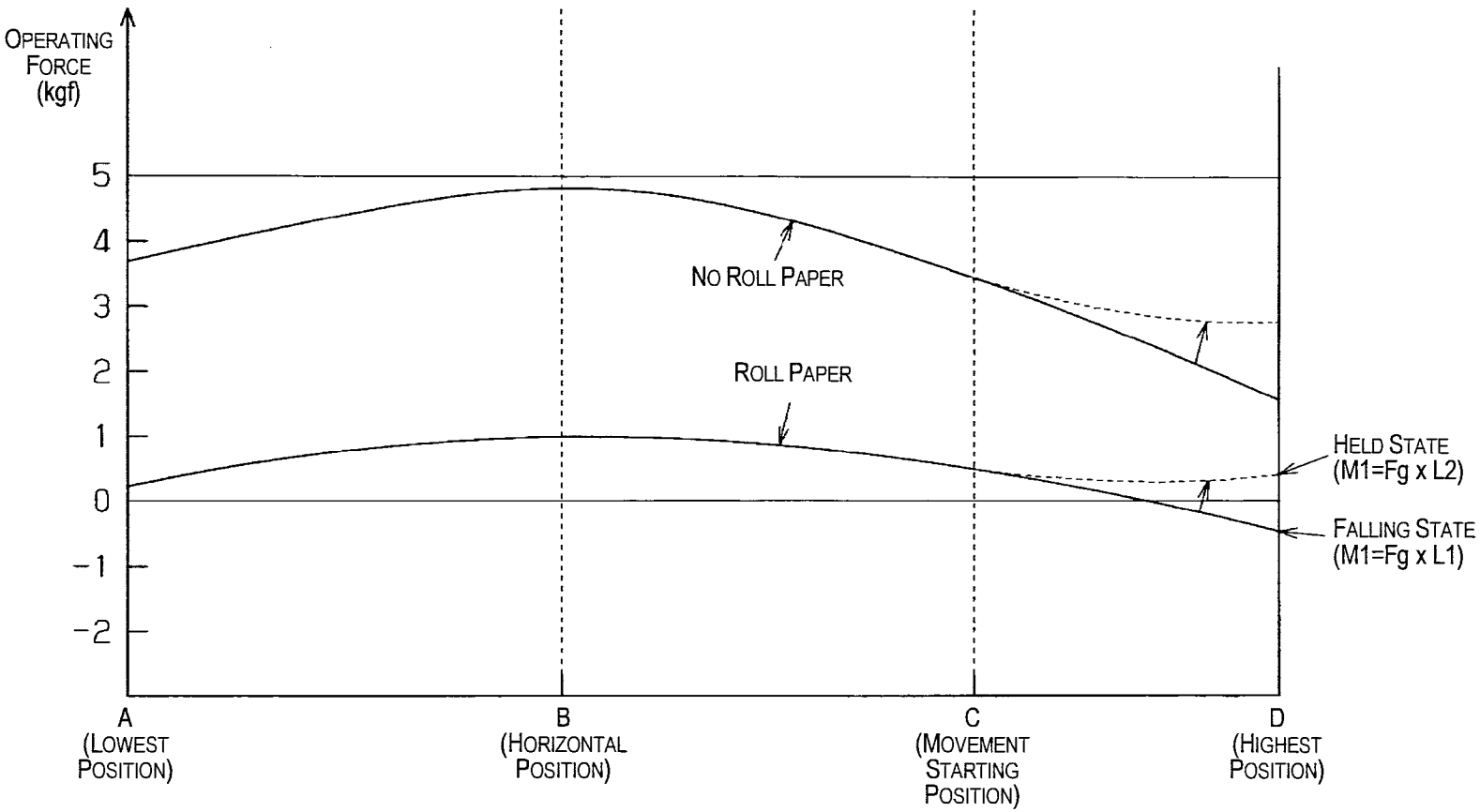
FIG. 5 is a graph showing the operating force which pushes down the roll paper accommodation unit in the first embodiment.

Next, the action of the roll paper accommodation device 100*a* of the present embodiment configured in this manner will be described using the operating force that pushes the roll paper accommodation unit 11 down from the highest position D to the lowest position A. FIG. 5 is a graph showing the operating force for pushing down the roll paper accommodation unit 11 when the roll paper accommodation unit 11 is swinging from the highest position D to the lowest position A.

The graphs shown in solid lines in FIG. 5 show the operating force when the shaft member 16 does not move within the opening hole 15*a*, and the graphs shown in dashed lines show the operating force when the shaft member 16 does move within the opening hole 15*a*. The "roll paper" graph shows the operating force when a new, unused roll paper P1 is accommodated, and the "no roll paper" graph shows the operating force when the accommodated roll paper P1 has all been consumed. In the present embodiment, the weight of the roll paper accommodation unit 11 accommodating the new roll paper P1 is approximately 7.5 Kgf, the distance between the first shaft J1 and the center of gravity G of the roll paper accommodation unit 11 is 260 mm, and the distance between the first shaft J1 and the position of a handle (not shown) operated by the operator when pushing down is 460 mm.

Regardless of whether or not there is roll paper, the operating force reaches a maximum at the horizontal position B, as shown in the graph. This is due to the fact that the rotational torque M2 caused by the urging force of the gas spring 18 reaches a maximum at the horizontal position B. Of course, at the horizontal position B, the rotational torque around the first shaft J1 caused by the weight of the roll paper accommodation unit 11 reaches a maximum as well, and the maximum value of the rotational torque M2 caused by the urging force of the gas spring 18 is therefore suppressed. As a result, the maximum value of the operating force is suppressed. In the present embodiment, the operator is guaranteed a certain ease of operation by setting the urging force of the gas spring 18 so that the maximum value of the operating force does not exceed a predetermined operating force (5 Kgf in this case) when there is no roll paper. When there is roll paper and the shaft member 16 does not move, sometimes the operating force is such that the rotational torque M1 at the highest position D is Fg×L1 and the operating force is negative, as in the graph shown by the solid line in the drawing. Specifically, the roll paper accommodation unit 11 is in a state of falling due to its own weight.

In view of this, by moving the shaft member 16 and increasing the rotational torque M2 as previously described, the operating force will increase from the movement starting position C of the shaft member 16 as in the graphs shown by the dashed lines in the drawing. At the highest position D, the operating force becomes positive because the torque value of the rotational torque M1 increases to Fg×L2 as previously described. As a result, at the highest position D, the roll paper accommodation unit 11 is held without falling. When the holding force at this time increases, the operating force opposing the holding force of course increases as well, and the torque values at which the rotational torque M1, i.e., the rotational torque M2, are expected to increase in a range in which the roll paper accommodation unit 11 does not fall at the highest position D are therefore preferably set to a minimum. With the rotation-transmitting unit 40 of the present embodiment, sometimes there is a difference between the rotational torque M1 and the rotational torque M2 due to the actual meshing of the gears, friction of the rotating shafts, or other factors in the spur gears 41 to 44. In such cases, this difference is preferably taken into account when setting the torque value at which the rotational torque M2 is expected to increase.

The urging direction of the gas spring 18 changes with the movement of the shaft member 16, but the present embodiment does not treat this as a small change and describes the urging direction as always being the direction opposite that of gravity. Of course, in practice, since the urging direction of the gas spring 18 changes with the movement of the shaft member 16, it is preferable to set the rotational torque M2 to an increased torque value by designing the movement amount of the shaft member 16, i.e., the shape of the guiding part SG, while taking this changing direction into account.

According to the first embodiment described above, the following effects can be achieved.

(1) At the highest position D, since the rotational torque of the lever member 15 caused by the gas spring 18 increases, there is also an increase in the rotational torque in the direction opposite that of gravity acting on the roll paper accommodation unit 11 which swings in conjunction with the lever member 15. Consequently, even in cases in which maximum-weight roll paper having a new, unused roll paper P1 or the like is accommodated, the roll paper accommodation unit 11 can be held in the highest position D so as to not swing (fall) in the direction of gravity. Since the gas spring 18 can be prevented from directly urging the roll paper accommodation unit 11, the lever member 15, the shaft member 16, the gas spring 18, and other mechanical components which cause the roll paper accommodation unit 11 to swing (rise) can be covered by the casing 13 so as to not be exposed, which is preferred in terms of outward appearance.

(2) The maximum rotational torque around the first shaft J1 caused by the weight of the roll paper accommodation unit 11 and the maximum rotational torque around the second shaft J2 caused by the urging force of the gas spring 18 cancel each other out. As a result, when a roll paper accommodation unit 11 containing no roll paper P1 is pushed down, for example, the downward-pushing force can be easily adjusted.

(3) The swinging of the roll paper accommodation unit 11 around the first shaft J1 and the swinging of the lever member 15 around the second shaft J2 can be reliably conjoined by the spur gears 41 to 44. Since the installed position of the second shaft J2 can be distanced from the first shaft J1, the range in which the lever member 15 can be installed in the roll paper accommodation device 100*a* is greater. As a result, there is a greater degree of freedom in disposing the gas spring 18 for urging the shaft member 16 engaged with the lever member 15, and the gas spring 18 can therefore be installed so as to be separate from the roll paper accommodation unit 11, for example. Consequently, the lever member 15, the shaft member 16, the gas spring 18, and other mechanical components which cause the roll paper accommodation unit 11 to swing (rise) can be covered by the casing 13 so as to not be exposed, which is preferred in terms of outward appearance.

(4) The rotation-transmitting unit 40 has two (an even number of) spur gears placed between the spur gear 41 and the spur gear 42. As a result, the spur gear 41 and the spur gear 42 rotate in opposite directions to each other. Consequently, the swinging direction of the roll paper accommodation unit 11 around the first shaft J1 when swinging from the lowest position A to the highest position D and the swinging direction of the lever member 15 swung by the gas spring 18 around the second shaft J2 are opposite directions. As a result, since the lever member 15 can be disposed on the side of the second shaft J2 opposite the roll paper accommodation unit 11, the gas spring 18 and the lever member 15 can be installed so as to be separated from the roll paper accommodation unit 11. Consequently, the lever member 15, the shaft member 16, the gas spring 18, and other mechanical components which cause the roll paper accommodation unit 11 to swing (rise) can be covered by the casing 13 so as to not be exposed, which is preferred in terms of outward appearance.

(5) With the roll paper accommodation device 100*a* of the present embodiment, even in cases in which maximum-weight roll paper P1 having new, unused roll paper or the like is accommodated, the roll paper accommodation unit 11 can be held in the highest position D so as to not swing (fall) in the direction of gravity. Consequently, according to the printer 10 comprising the roll paper accommodation device 100*a* of the present embodiment, it is possible to achieve a liquid ejection head wherein, for example, the roll paper P2 accommodated in the casing 13 can be easily replaced. It is possible to achieve a liquid ejection device in which the lever member 15, the shaft member 16, the gas spring 18, and other mechanical components which cause the roll paper accommodation unit 11 to swing (rise) are covered by the casing 13 so as to not be exposed, which is preferred in terms of outward appearance.

Second Embodiment

Next, the second embodiment will be described. The second embodiment is a roll paper accommodation device having a configuration that uses a chain instead of spur gears as the rotation-transmitting unit 40 in the first embodiment. It is also a roll paper accommodation device configured so that the movement of the shaft member 16 in the lever member 15 described in the first embodiment is performed by another member.

Figure 6:
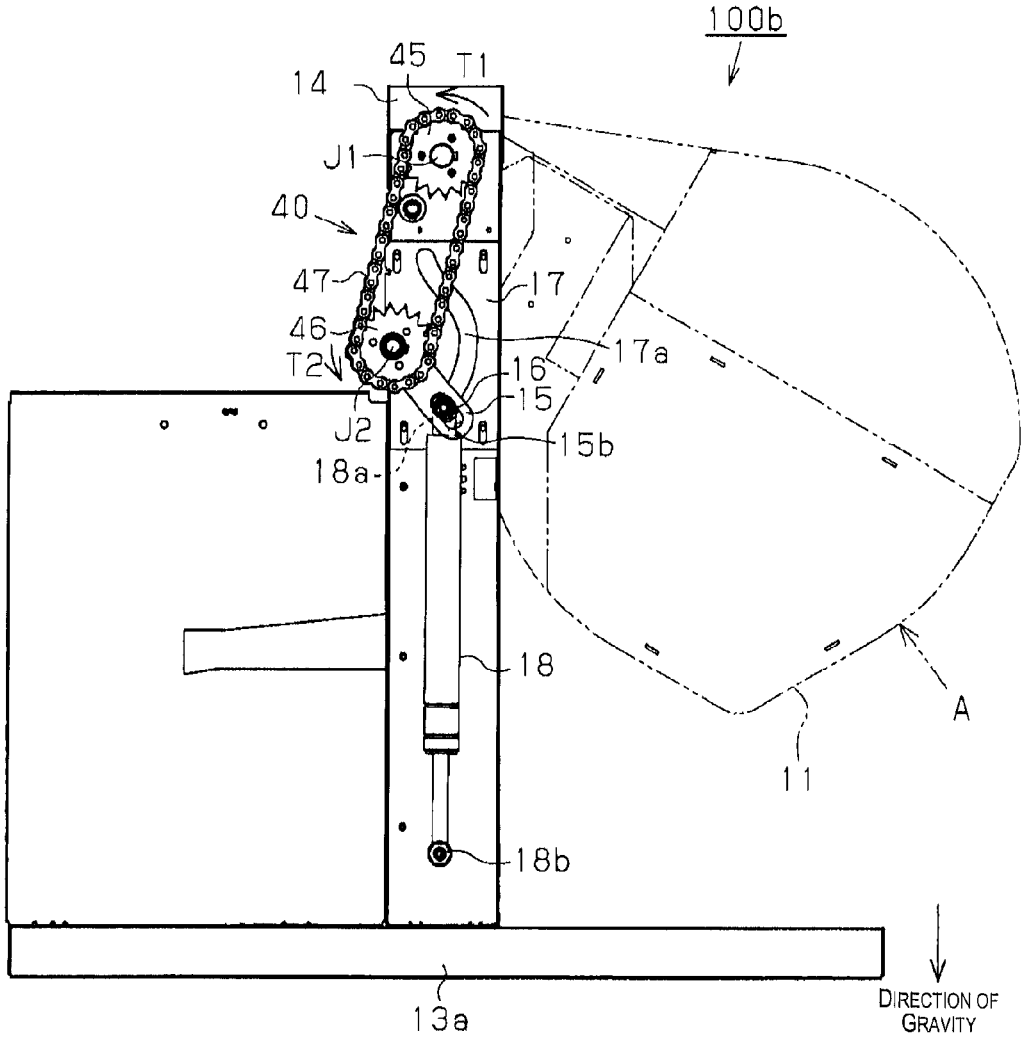
FIG. 6 is a side view showing the configuration of a roll paper accommodation device of the second embodiment.

FIG. 6 is a side view showing the configuration of a roll paper accommodation device 100*b* of the second embodiment, and is a drawing equivalent to FIG. 3 described in the first embodiment above. Structural elements identical to those of the first embodiment are denoted by the same symbols, and descriptions thereof are omitted. Structural elements associated with the printer 10 are also not shown. In the description hereinbelow, similar to the first embodiment, the direction of gravity is sometimes referred to as "down" or "downward," and the direction opposite that of gravity is sometimes referred to as "up" or "upward."

In the roll paper accommodation device 100*b* of the present embodiment, as shown in FIG. 6, the roll paper accommodation unit 11 is mounted in the same manner as in the first embodiment so as to swing around the first shaft J1 provided in a position at the top of the two support braces 14. A second shaft J2 is turnably provided to both of the support braces 14 at a position separated from the first shaft J1.

In the present embodiment, a sprocket 45 is mounted on the first shaft J1 as a first gear which turns integrally with the roll paper accommodation unit 11 around the first shaft J1. Formed on the second shaft J2 is a rotation-transmitting unit 40 composed of a sprocket 46 as a second gear which turns around the second shaft J2, and a chain 47 extending between the sprocket 45 and the sprocket 46. This rotation-transmitting unit 40 is configured so as to transmit the rotation of the first shaft J1 which turns with the swinging of the roll paper accommodation unit 11 and to turn the second shaft J2 in conjunction with the first shaft J1. Alternatively, the configuration is designed so that by instead transmitting the turning of the second shaft J2 to the first shaft, the roll paper accommodation unit 11 swings in conjunction with the turning of the second shaft J2 around the first shaft. In the present embodiment, the sprocket 45 and the sprocket 46 are configured from gears having the same number of teeth and pitch diameter. Consequently, the rotational angle around the first shaft J1 and the rotational angle around the second shaft coincide, and the rotational torque T1 around the first shaft J1 (hereinafter simply "rotational torque T1") and the rotational torque T2 around the second shaft J2 (hereinafter simply "rotational torque T2") have the same torque value.

As in the first embodiment, a plate-shaped lever member 15 is provided being fixed to the second shaft J2 (or the sprocket 46) so as to swing around the second shaft J2 integrally with the turning of the second shaft J2. An opening hole 15*b* is provided in this lever member 15. Provided inside the opening hole 15*b* is a shaft member 16 which is capable of moving within the opening hole 15*b* in a direction orthogonal to the axial direction of the second shaft J2, i.e., along the plate surface direction of the lever member 15, while being engaged with the opening hole 15*b*.

Furthermore, in the roll paper accommodation device 100*b* of the present embodiment, a guide member 17 is disposed as being fixed to the support braces 14 so as to overlap the lever member 15 in the same plane. In this guide member 17, a guide part 17*a* is formed in which the cylindrical side surface of one end of the shaft member 16 slides. In the present embodiment, the guide part 17*a* and the shaft member 16 constitute a cam mechanism. Specifically, the guide part 17*a* is an opening hole whose opening has a substantial S shape, and the movement position of the shaft member 16 in the opening hole 15*b* provided in the lever member 15 is established by the side surface portion of the shaft member 16 sliding while in contact with this opening hole of a guide part 17*a*. Thus, the guide member 17 functions as a member for moving the shaft member 16 within the opening hole 15*b* while the shaft member 16 is engaged with the opening hole 15*b*.

As in the first embodiment, the shaft member 16 is fixed to one end (the top end) 18*a* of the gas spring 18 as urging unit. The other end (the bottom end) 18*b* of the gas spring 18 is turnably fixed to the support braces 14. Consequently, the gas spring 18 is configured so as to urge the shaft member 16 upward by an urging force. As a result, the shaft member 16 engaged with the opening hole 15*b* subjects the lever member 15 to the urging force, which causes the lever member 15 to swing around the second shaft J2, with its point of contact with the opening hole 15*b* as the operative point.

In the roll paper accommodation device 100*b* of the second embodiment configured in this manner, the configuration is designed so that when the lever member 15 swings by the urging force of the gas spring 18, this swinging causes the roll paper accommodation unit 11 to swing from the state of the lowest position A shown in FIG. 6 to the highest position D (see FIG. 3). At this time, in the present embodiment, unlike the first embodiment, the movement position of the shaft member 16 within the opening hole 15*b*, i.e., the operative point of the urging force of the gas spring 18, is established by the guide part 17*a* provided to the guide member 17. This configuration is described in detail using FIG. 7 together with the movement action of the shaft member 16.

Figure 7:
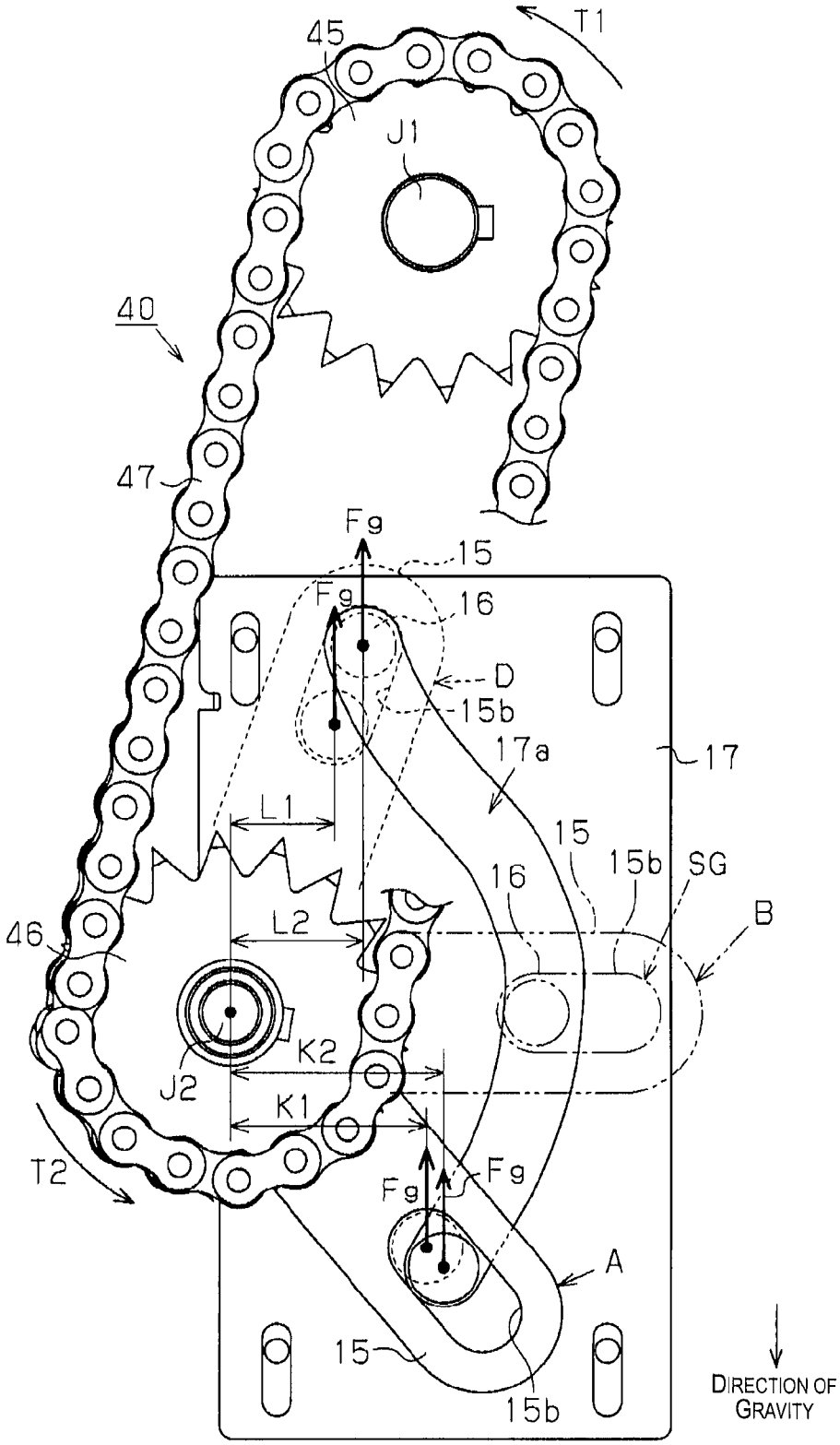
FIG. 7 is a descriptive drawing for describing the movement of the shaft member through the swinging positions in the second embodiment.

FIG. 7 is an enlarged view of part of FIG. 6, showing the configurations of the lever member 15, the shaft member 16, the guide member 17, and the rotation-transmitting unit 40. In FIG. 7, there are no depictions of structural elements of the roll paper accommodation device 100*b* that are not necessary for describing the movement action of the shaft member 16.

As previously described, when the lever member 15 is swung by the urging force of the gas spring 18 around the first shaft J1, the roll paper accommodation unit 11 swings around the first shaft J1, similar to the first embodiment. At this time, in FIG. 7, the position of the lever member 15 shown by the solid lines is the lowest position A of the roll paper accommodation unit 11, the position shown by the double-dashed lines is the horizontal position B of the roll paper accommodation unit 11, and the position shown by the dashed lines is the highest position D of the roll paper accommodation unit 11.

As illustrated, the opening hole 15*b* provided to the lever member 15 has circular holes opened respectively around two positions at different distances from the second shaft J2, and an elliptical shape in which these two circular holes are joined by a linear slit having an opening width equal to the outside diameter dimensions of the circular holes. In the present embodiment, the opening hole 15*b* is formed so that the center line of this elliptical shape, i.e., the center line of the linear slit portion, passes through the center of the second shaft J2. In the guide member 17 disposed so as to overlap the lever member 15 in the same plane, a guide part 17*a* is formed having a substantially S-shaped open shape roughly equivalent to the lower three-fourths of a letter S.

The opening hole 15*b* and the guide part 17*a* having such shapes cause the shaft member 16, which urges the lever member 15 in the opposite direction of gravity while being engaged with the opening hole 15*b*, to move within the opening hole 15*b* in the following manner. Specifically, first, when the lever member 15 is in a position corresponding to the lowest position A as shown by the solid lines in the drawing, the shaft member 16 is in a position slightly separated from the nearest possible position to the second shaft J2 within the elliptical shape of the opening hole 15*b*. Next, when the lever member 15 swings from the lowest position A to a position corresponding to the horizontal position B, the shaft member 16 moves so as to gradually be nearer to the second shaft J2 within the elliptical shape of the opening hole 15*b*, and comes to the nearest position to the second shaft J2 within the elliptical shape in the horizontal position B as shown by the double-dashed lines in the drawing. When the lever member 15 swings from the horizontal position B to a position corresponding to the highest position D, the shaft member 16 moves gradually away from the second shaft J2 within the elliptical shape of the opening hole 15*b*, and comes to the farthest position from the second shaft J2 within the elliptical shape at the highest position D as shown by the dashed lines in the drawing. In other words, the configuration is designed so that the distance between the center of the second shaft J2 and the center of the shaft member 16 is longer in the highest position D, which is the high position in the direction of gravity, than in the horizontal position B, which is lower in the direction of gravity than the high position. Additionally, the present embodiment is configured so that the distance between the center of the second shaft J2 and the center of the shaft member 16 is longer in the highest position D than in the lowest position A.

The shaft member 16, which serves as the operative point of the urging force of the gas spring 18 in this manner, is configured so as to be in such positions within the opening hole 15*b* due to sliding against the guide part 17*a*. At this time, the shaft member 16 which slides in the guide part 17*a* moves within the opening hole 15*b* while in contact with the upper shape portion thereof, with the opening hole 15*b* provided to the lever member 15 as a guiding part SG as in the first embodiment described above.

Consequently, in the present embodiment, in the highest position D as shown in FIG. 7, L1 is the distance of separation between the second shaft J2 and the shaft member 16 in the direction orthogonal to the direction of gravity when the shaft member 16 does not move from its position in the horizontal position B. On the other hand, when the shaft member 16 has moved within the opening hole 15*b* as described above when swinging from the low position in the direction of gravity to the highest position D, the distance of separation between the second shaft J2 and the shaft member 16 in the direction orthogonal to the direction of gravity is L2, which is a greater value than L1. Consequently, denoting the urging force of the gas spring 18 as Fg, the rotational torque T2 in the highest position D can be denoted as Fg×L2, which is greater than Fg×L1. As a result, the rotational torque T1 opposing the falling of the roll paper accommodation unit 11 in the direction of gravity in the highest position D can also be denoted as Fg×L2, which is greater than Fg×L1.

Furthermore, in the present embodiment, when the lever member 15 is in the position corresponding to the lowest position A as described above, the shaft member 16 moves from the position nearest to the second shaft J2 within the hole edge forming the elliptical shape of the opening hole 15*b* (i.e., its position in the horizontal position B) to a position slightly farther from the second shaft J2. At this time, K1 is the distance of separation between the second shaft J2 and the shaft member 16 in the direction orthogonal to the direction of gravity, assuming the shaft member 16 in the lowest position A does not move from its position in the horizontal position B, as shown in FIG. 7. On the other hand, in the lowest position A, when the shaft member 16 has moved within the opening hole 15*a* as described above, the distance of separation between the second shaft J2 and the shaft member 16 in the direction orthogonal to the direction of gravity is K2, which is a greater value than K1. Consequently, denoting the urging force of the gas spring 18 as Fg, the rotational torque T1 around the first shaft J1 opposing the roll paper accommodation unit 11 in the direction of gravity at the lowest position A can be denoted as Fg×K2, which is greater than Fg×K1.

Figure 8:
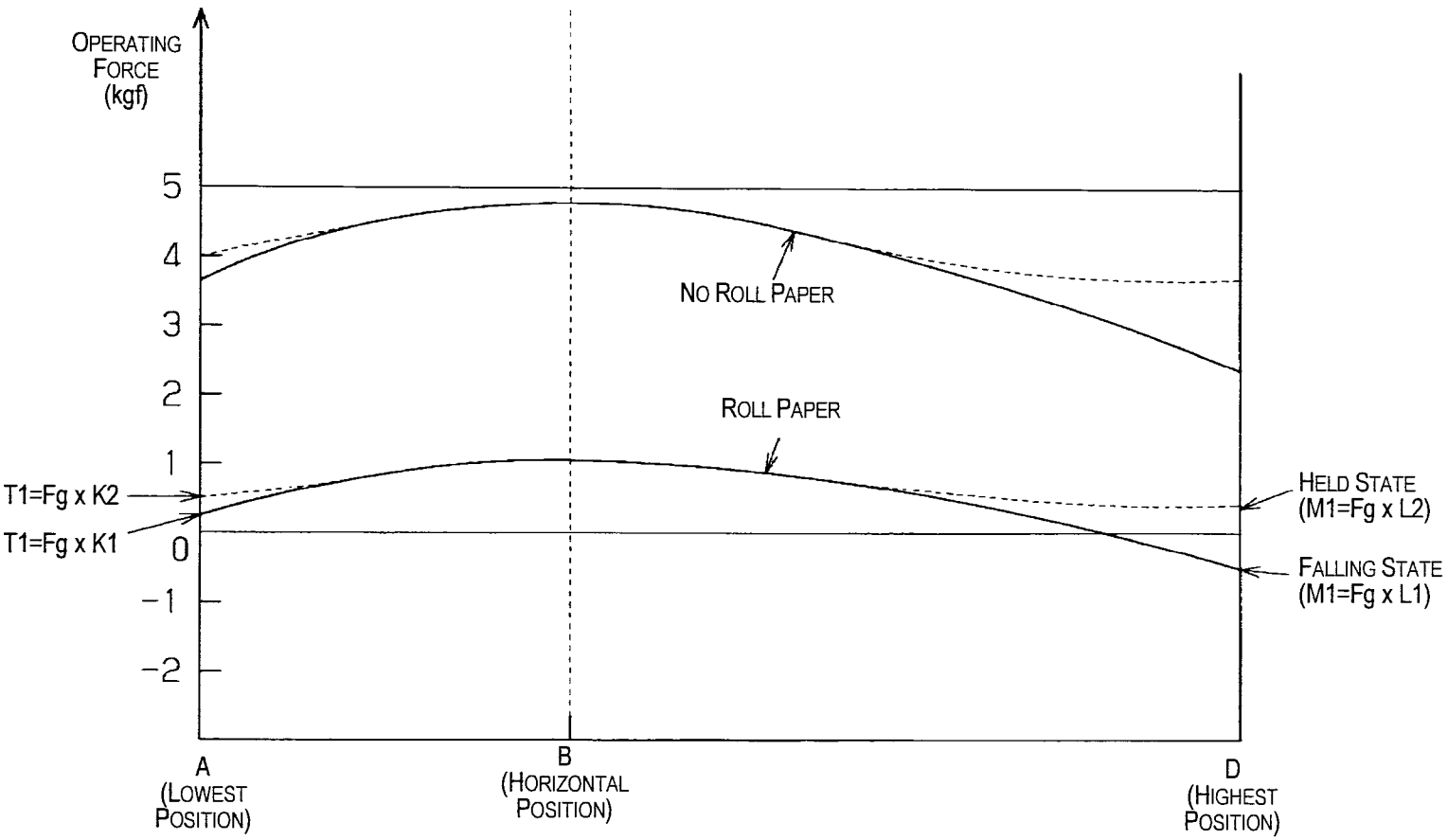
FIG. 8 is a graph showing the operating force which pushes down the roll paper accommodation unit in the second embodiment.

Next, the action of the roll paper accommodation device 100*b* of the present embodiment configured in this manner is described using the operating force which pushes the roll paper accommodation unit 11 down from the highest position D to the lowest position A. FIG. 8 is a graph similar to FIG. 5 of the first embodiment. Specifically, FIG. 8 is a graph showing the operating force which pushes the roll paper accommodation unit 11 down while the roll paper accommodation unit 11 is swinging (falling) from the highest position D to the lowest position A. The graphs shown in solid lines in FIG. 8 show the operating force when the shaft member 16 does not move from its position in the horizontal position B, and the graphs shown in dashed lines show the operating force when the shaft member 16 is moved by the guide part 17*a*. The "roll paper" graph shows the operating force when a new roll paper P1 is accommodated, and the "no roll paper" graph shows the operating force when the accommodated roll paper P1 has all been consumed. In the present embodiment, as in the first embodiment, the weight of the roll paper accommodation unit 11 accommodating the new roll paper P1 is approximately 7.5 Kgf, the distance between the first shaft J1 and the center of gravity G of the roll paper accommodation unit 11 is 260 mm, and the distance between the first shaft J1 and the position of a handle (not shown) operated by the operator when pushing down is 460 mm.

As in the first embodiment, regardless of whether or not there is roll paper, the operating force reaches a maximum at the horizontal position B, as shown in the graph. The operator is guaranteed a certain ease of operating by setting the urging force of the gas spring 18 so that the maximum value of the operating force does not exceed a predetermined operating force (5 Kgf in this case) when there is "no roll paper." Consequently, in the present embodiment, the maximum rotational torque around the second shaft J2 by the gas spring 18 is kept low by ensuring that the shaft member 16 and the second shaft J2 are as close as possible in the horizontal position B. As a result, when there is roll paper and the shaft member 16 does not move, the rotational torque T1 at the highest position D is Fg×L1 and the operating force is negative, as in the graph shown by the solid line in the drawing, similar to FIG. 5. Specifically, the roll paper accommodation unit 11 is in a state of falling due to its own weight.

In view of this, in the present embodiment, unlike the first embodiment described above, the shaft member 16 is moved from any desired position past the horizontal position B within the opening hole 15*b* provided to the lever member 15 by using the guide member 17 as described above when the roll paper accommodation unit 11 swings. Consequently, the operating force opposing the increasing rotational torque T2 can be increased from any desired position past the horizontal position B as indicated in the graphs shown by the dashed lines. At the highest position D, the rotational torque T2, i.e., the rotational torque T1, is Fg×L2, and the operating force becomes positive. As a result, the roll paper accommodation unit 11 is held without falling at the highest position D. When the holding force at this time increases, the operating force opposing the holding force of course increases as well, and the rotational torque values, which are expected to increase in a range in which the roll paper accommodation unit 11 does not fall at the highest position D, are therefore preferably set to a minimum.

In the present embodiment, when the roll paper accommodation unit 11 is pushed down to the lowest position A by using the guide member 17, the shaft member 16 is moved within the opening hole 15*b* provided to the lever member 15 from any desired position past the horizontal position B, unlike the first embodiment described above. Consequently, the rotational torque T2, i.e., the rotational torque T1, can be increased from any desired position past the horizontal position B as indicated in the graphs shown by the dashed lines. At the lowest position A, the rotational torque T1 is Fg×K2, and the operating force increases and approaches the value of the operating force in the horizontal position B. As a result, during the process of falling from the highest position D through the horizontal position B to the lowest position A, it is possible to reduce the change in the operating force which pushes down on the roll paper accommodation unit 11. With the rotation-transmitting unit 40 of the present embodiment, sometimes there is a difference between the rotational torque T1 and the rotational torque T2 due to the actual meshing of the chain 47, friction of the rotating shafts, or other factors in the spur gears 45, 46. In such cases, this difference is preferably taken into account when setting the rotational torque value that is expected to increase.

As in the first embodiment described above, the urging force of the gas spring 18 changes with the movement of the shaft member 16, but the present embodiment also does not treat this as a small change and describes the urging direction as always being the direction opposite that of gravity. Of course, in practice, since the urging direction of the gas spring 18 changes with the movement of the shaft member 16, it is preferable to set the rotational torque M2 to an increased torque value by designing the movement amount of the shaft member 16, i.e., the shape of the guide part 17*a*, while taking this changing direction into account.

According to the second embodiment described above, the following effects can be achieved in addition to the effects (1), (2), and (5) in the first embodiment.

(6) When the roll paper accommodation unit 11 is swung (raised), the distance between the center of the shaft member 16 and the center of the second shaft J2 can be varied as desired, and the rotational torque around the first shaft J1 for raising the roll paper accommodation unit 11 can therefore be varied as desired. Consequently, by forming the guide part 17*a* into a substantial S shape and adjusting the rotational torque in accordance with the urging force of the gas spring 18, the rotational torque can be adjusted so that there is no increase in the operating force which pushes the roll paper accommodation unit 11 down from the highest position D to the lowest position A against this rotational torque. During the process of the roll paper accommodation unit 11 falling from the highest position D through the horizontal position B to the lowest position A, the change in operating force pushing down on the roll paper accommodation unit 11 can be reduced, and the operator can therefore push the roll paper accommodation unit 11 down smoothly.

(7) During the falling process of the roll paper accommodation unit 11, since the shaft member 16 and the second shaft J2 are nearest to each other in the horizontal position B, the maximum value of the rotational torque around the second shaft J2 for raising the roll paper accommodation unit 11 can be kept low. Consequently, the maximum value of the downward pushing force when the roll paper accommodation unit 11 is pushed down can be reduced, and the maximum value of the downward pushing force when the roll paper accommodation unit 11 is at its lightest can therefore be suppressed to increase operability for the operator.

(8) The swinging of the roll paper accommodation unit 11 around the first shaft J1 and the swinging of the lever member 15 around the second shaft J2 can be reliably conjoined by the sprockets 45, 46 and the chain 47. Since the position of the second shaft J2 can be distanced from the first shaft J1, the range in which the lever member 15 can be installed in the roll paper accommodation device 100*b* is increased. Consequently, the lever member 15, the shaft member 16, the gas spring 18, and other mechanical components which cause the roll paper accommodation unit 11 to swing (rise) can be covered by the casing 13 so as to not be exposed, which is preferred in terms of outward appearance.

The embodiments described above may be modified to other embodiments as follows.

Figure 9:
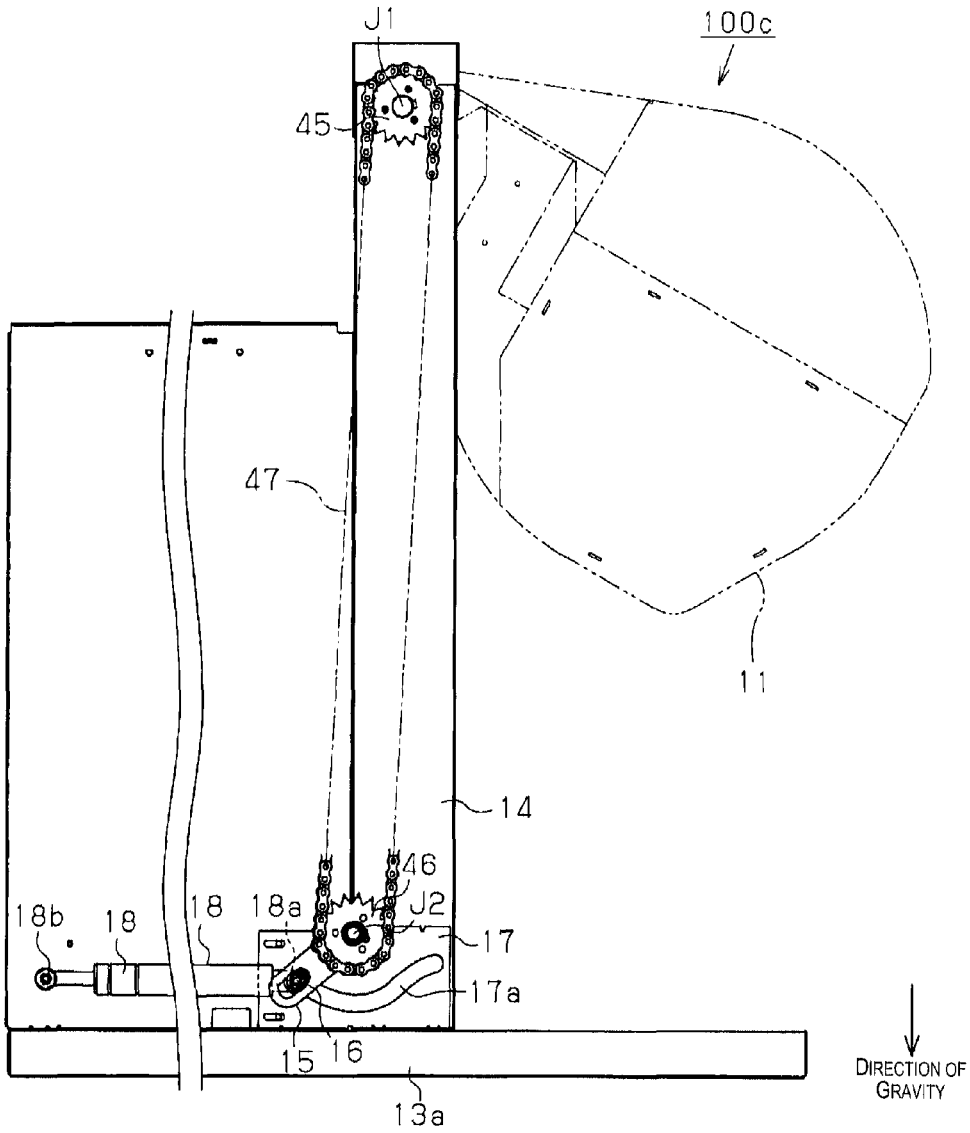
FIG. 9 is a perspective view showing the configuration of a roll paper accommodation device as a modification of the second embodiment.

In the second embodiment described above, the gas spring 18 may be disposed so that, e.g., the urging force acts in a direction that intersects the direction of gravity. This modification is described using FIG. 9. FIG. 9 is a side view corresponding to FIG. 6 used in the description of the second embodiment.

In the roll paper accommodation device 100*c* of the present modification, at the bottom part of a support brace 14 is provided a second shaft J2, which is the rotational center of a sprocket 46 which rotates in conjunction with a sprocket 45 and a chain 47, as shown in the drawing. A plate-shaped lever member 15, which swings around the second shaft J2 integrally with the turning of the second shaft J2, is provided as being fixed so as to swing below the second shaft J2. A guide member 17, which is disposed so as to overlap the lever member 15 in the same plane, is also provided to the bottom part of the support brace 14 so that the substantial S shape of a guide part 17*a* through which a shaft member 16 slides is oriented such that its longitudinal direction is lateral, intersecting the direction of gravity. Consequently, one end 18*a* of a gas spring 18 is fixed to the shaft member 16, and the other end 18*b* is fixed to a base part 13*a* via a fixing plate (not shown) which is axially supported so as to be capable of turning.

The roll paper accommodation device 100*c* having this type of configuration is effective in cases in which, for example, it is difficult in the printer 10 to incorporate in the direction of gravity a roll paper accommodation device including the gas spring 18. It is also easy for the gas spring 18 to be accommodated within the casing 13 when the length of the casing 13 in the lateral direction intersecting the direction of gravity is longer than the length in the vertical direction which is the direction of gravity. The weight of the rod can also be expected to have little effect on the urging force of the gas spring 18 (the effect on the rotational torque (a reduction in the urging force) in the highest position D in particular is suppressed).

Figure 10:
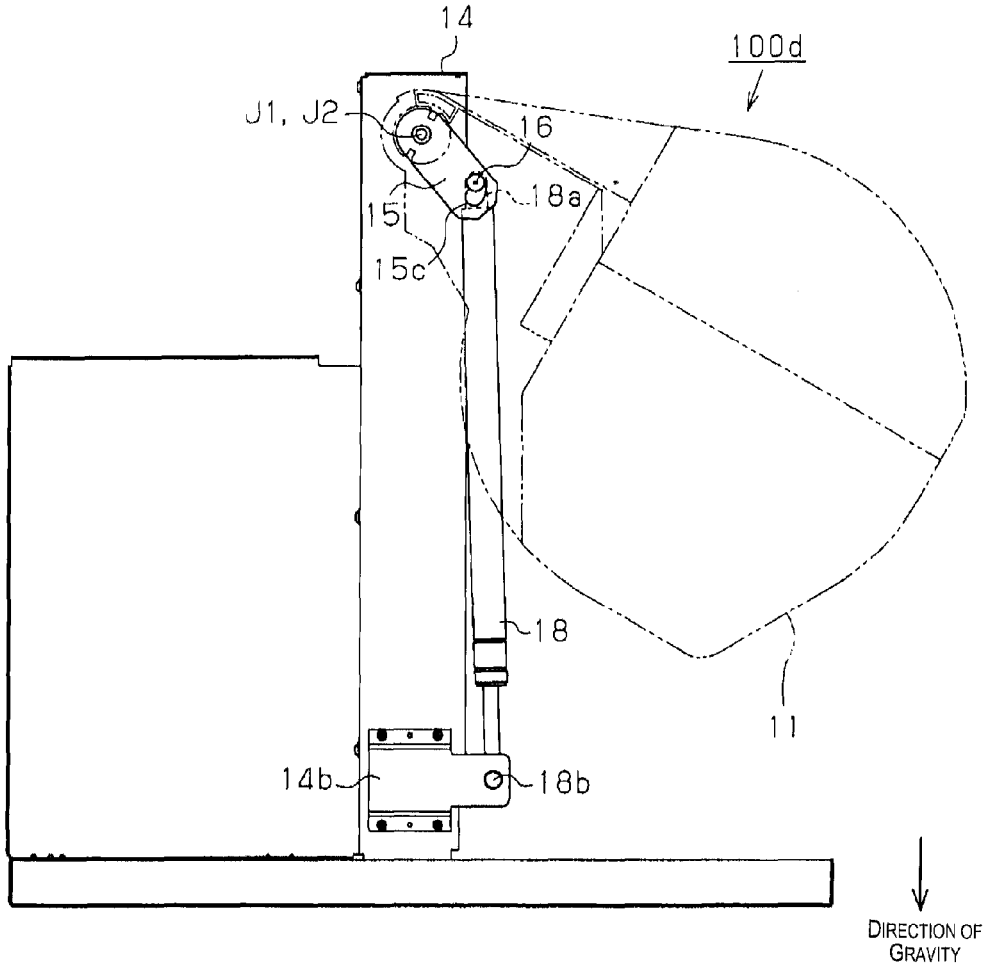
FIG. 10 is a perspective view showing the configuration of a roll paper accommodation device as a modification.

In the embodiments described above, the first shaft J1 and the second shaft J2 may be the same shaft. This modification is described using FIG. 10. FIG. 10 is a drawing showing the roll paper accommodation device 100*d* of the present modification, and is a side view corresponding to FIG. 3 used in the description of the first embodiment.

The roll paper accommodation device 100*d* is not provided with a rotation-transmitting unit 40 (see FIG. 3) and is configured with the first shaft J1 and the second shaft J2 as the same shaft, as shown in the drawing. Specifically, the first shaft J1 which is the swinging center of the roll paper accommodation unit 11 and the second shaft J2 which is the swinging center of the lever member 15 swung by the urging force of the gas spring 18 are provided as the same shaft to the support braces 14. Therefore, unlike the first embodiment described above, the swinging direction of the lever member 15 around the second shaft J2 and the swinging direction of the roll paper accommodation unit 11 around the first shaft J1 coincide. In this case, the angle ranges of swinging are of course the same as well.

In view of this, the roll paper accommodation device 100*d* of the present modification is configured so that the shaft member 16 which moves within an opening hole 15*c* formed in the lever member 15 is positioned on the same side (the right side in the drawing) of the second shaft J2 (the first shaft J1) as the roll paper accommodation unit 11, as shown in the drawing. The lever member 15 in the present modification has the inverse shape of the lever member 15 in the first embodiment described above, and the opening hole 15*c* therefore has a shape that is axisymmetric with the opening hole 15*a* in the first embodiment. One end (the top end) 18*a* of the gas spring 18 is fixed to the shaft member 16, and the other end (the bottom end) 18*b* is turnably fixed to the support brace 14 via a fixed plate 14*b*.

As a result, the urging force of the gas spring 18 is applied to the shaft member 16, whereby the shaft member 16 operates so as to swing the lever member 15 in the direction opposite that of gravity around the second shaft J2. As a result, the roll paper accommodation unit 11 swings in the direction opposite that of gravity around the first shaft J1, which is the same shaft as the second shaft J2. During this swinging, the shaft member 16 moves within the opening hole 15*c* so as to move away from the second shaft J2 (the first shaft J1), whereby the rotational torque caused by the urging force of the gas spring 18 is increased when the roll paper accommodation unit 11 is positioned in the highest position D.

Consequently, with the roll paper accommodation device 100*d* of the present modification, the roll paper accommodation unit 11 can be held so as to not fall, similar to the first embodiment described above, and since there is no need for a mechanism for conjoining the turning of the first shaft J1 and the second shaft J2, the roll paper accommodation device is not increased in size. The load of manufacturing the roll paper accommodation device is also reduced.

For the rotation-transmitting unit 40 in the first embodiment described above, the rotation-transmitting unit 40 in the second embodiment, i.e., the sprockets and chain, may be used instead of the gear train. For the rotation-transmitting unit 40 in the second embodiment described above, the rotation-transmitting unit 40 in the first embodiment, i.e., the gear train, may be used instead of the sprockets and chain. In either case, the rotation of the first shaft J1 and the rotation of the second shaft J2 can be reliably conjoined.

In the embodiments described above, the gas spring 18 was used as urging unit, but a coil spring, for example, may also be used. As long as the urging unit can yield the urging force described above, it is not particularly limited to these springs.

In the embodiments described above, the opening holes 15*a*, 15*b* formed in the lever member 15 may be shapes having an open state in which there is no component material in the bottom sides, i.e., the sides toward the direction of gravity. As described above, the shaft member 16 is moved by the urging force of the gas spring 18 along the top sides of the opening holes 15*a*, 15*b* as guiding parts SG, and the bottom sides may therefore be open. If the shape allows the shaft member 16 to move along the shape, it need not be an opening hole and may instead be, for example, a concave shape.

In the embodiments described above, the guide part 17*a* formed in the guide member 17 need not be an opening hole. The guide part may be, for example, a concavity. In short, if the guide part 17*a* and the shaft member 16 constitute a cam mechanism in which the shaft member 16 can slide, any shape can be used.

In the rotation-transmitting unit 40 in the first embodiment described above, at least the spur gear 41 which rotates integrally with the first shaft J1 and the spur gear 42 which rotates integrally with the second shaft J2 may be configured having different numbers of teeth, i.e., different pitch diameters. In the rotation-transmitting unit 40 in the second embodiment described above, the sprocket 45 which rotates integrally with the first shaft J1 and the sprocket 46 which rotates integrally with the second shaft J2 may also be configured having a different number of teeth, i.e., different pitch diameters. With such a configuration, the rotational angle of the first shaft J1 and the rotational angle of the second shaft J2 can be made to differ when the first shaft J1 and the second shaft J2 rotate in conjunction.

For example, the spur gear 42 (the sprocket 46) can have more teeth (a greater pitch diameter) than the spur gear 41 (the sprocket 45). With this configuration, the rotational angle of the second shaft J2 can be smaller than the rotational angle of the first shaft J1, which is effective in cases in which, for example, the swinging angle of the lever member 15 within the space of the roll paper accommodation device 100 must be smaller than the swinging angle of the roll paper accommodation unit 11. In this case, more rotational torque around the second shaft is needed in order to swing the lever member 15, and a gas spring 18 having a stronger urging force is therefore used.

The spur gear 42 (the sprocket 46) can also have fewer teeth (a smaller pitch diameter) than the spur gear 41 (the sprocket 45). With this configuration, the rotational torque of the second shaft J2 can be less than the rotational torque of the first shaft J1, and even a gas spring 18 having a small urging force value, for example, can therefore be used. In this case, the swinging angle of the lever member 15 is greater than the swinging angle of the roll paper accommodation unit 11.

In the embodiments described above, a liquid ejection device was specified as the inkjet printer 10, but a liquid ejection device that ejects or discharges a liquid other than ink may also be used. The present invention is applicable to various liquid ejection devices comprising liquid ejection heads or the like for discharging droplets in extremely small amounts. The term "droplets" refers to the state of the liquid discharged from the liquid ejection device, and includes that which leaves trails of grains, tears, or threads. The liquid referred to herein need only be a substance that can be ejected by the liquid ejection device. For example, the material need only be in the state of a liquid phase, which includes not only fluids such as liquids of high and low viscosity; sols, gels, and other inorganic solvents; organic solvents; solutions; liquid resins; and liquid metals (metal melts); and liquids as one state of the substance; but also includes liquids containing functional materials composed of pigments, metal particles, or the other solids which are dissolved, dispersed, or mixed in a solvent. Typical examples of the liquids include ink such as the ink described in the embodiments described above, liquid crystal, and the like. The term "ink" used herein includes common water-based ink and oil-based ink, as well as gel ink, hot melt ink, and other various liquid compositions. Specific examples of the liquid ejection device include devices such as those described in the embodiments, wherein a rolled medium accommodation unit containing roll paper, which is paper wound into the form of a roll, but the present invention can be applied to any liquid ejection device that is capable of containing the liquid ejection target in the form of a wound roll.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

a first rolled medium accommodation unit configured to accommodate a rolled medium, the first rolled medium accommodation unit being movable along a first path;

a second rolled medium accommodation unit configured to accommodate the rolled medium, the second rolled medium accommodation unit being movable along a second path; and a liquid ejection head configured to eject an ink as a liquid onto a medium supplied by being unwound from the rolled medium.

2. The liquid ejection device according to claim 1, wherein the first path is an arcuate path, and the second path is a straight path.

3. The liquid ejection device according to claim 1, wherein the second rolled medium accommodation unit is movable over a base part having a pair of support braces standing upright from the base part, and the first rolled medium accommodation unit is supported by the support braces.

4. The liquid ejection device according to claim 1, wherein the second rolled medium accommodation unit is movable between a pair of partitioning plates fixedly coupled to one of a base part and a pair of support braces.

5. The liquid ejection device according to claim 1, wherein the second rolled medium accommodation unit is disposed at a position lower than a highest position of the first rolled medium accommodation unit along the first path.

* * * * *